US008979232B2

(12) United States Patent
Usuda

(10) Patent No.: US 8,979,232 B2
(45) Date of Patent: Mar. 17, 2015

(54) IMAGE FORMING APPARATUS AND IMAGE FORMING METHOD

(71) Applicant: Seiko Epson Corporation, Tokyo (JP)

(72) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 130 days.

(21) Appl. No.: 13/633,184

(22) Filed: Oct. 2, 2012

(65) Prior Publication Data

US 2013/0088539 A1 Apr. 11, 2013

(30) Foreign Application Priority Data

| | | |
|---|---|---|
| Oct. 11, 2011 | (JP) | 2011-223654 |
| Nov. 1, 2011 | (JP) | 2011-240064 |
| Aug. 9, 2012 | (JP) | 2012-176771 |
| Aug. 9, 2012 | (JP) | 2012-176772 |

(51) Int. Cl.

| | |
|---|---|
| ***B41J 29/38*** | (2006.01) |
| ***B41J 2/21*** | (2006.01) |
| ***B41J 11/00*** | (2006.01) |

(52) U.S. Cl.

CPC ..... *B41J 29/38* (2013.01); *B41J 2/2117* (2013.01); *B41J 11/002* (2013.01)

USPC ..... 347/12

(58) Field of Classification Search

CPC ..... B41J 2/04541; B41J 2/04543; B41J 2/04573; B41J 2/0458; B41J 2/04581; B41J 2/145; B41J 2/15; B41J 2/155; B41J 2/1631; B41J 2/2103; B41J 2/2107; B41J 2/2132; B41J 19/142; B41J 19/147; B41J 2002/14491; B41J 2202/19; B41J 2202/20; B41J 2202/21; B41J 2/0452; B41J 2/04525; B41J 2/04545; G06K 15/105; G06K 15/107; G06K 2215/0094

USPC ..... 347/5–20, 40–44, 96, 101, 102

See application file for complete search history.

(56) References Cited

U.S. PATENT DOCUMENTS

| | | | | |
|---|---|---|---|---|
| 7,407,277 | B2 | 8/2008 | Yoneyama | |
| 2005/0237352 | A1 | 10/2005 | Yoneyama | |
| 2010/0238211 | A1* | 9/2010 | Usuda et al. | 347/9 |
| 2011/0037804 | A1* | 2/2011 | Oyanagi et al. | 347/20 |
| 2011/0234660 | A1* | 9/2011 | Yoshida | 347/9 |

FOREIGN PATENT DOCUMENTS

| | | | |
|---|---|---|---|
| JP | 2001-010221 | A | 1/2001 |
| JP | 2010-076102 | A | 4/2010 |
| WO | 2005/105452 | A1 | 11/2005 |

* cited by examiner

*Primary Examiner* — Manish S Shah
*Assistant Examiner* — Roger W Pisha, II
(74) *Attorney, Agent, or Firm* — Mascoff Brennan

(57) ABSTRACT

An image forming apparatus includes a nozzle row group that is provided with a first nozzle row and a second nozzle row, and a control unit that performs a dot forming operation of ejecting a liquid from nozzles to form dots. The control unit divides the first nozzle row and the second nozzle row into N nozzle groups when the dot forming operation is performed. In a first mode, A nozzle groups of N nozzle groups of the second nozzle row and (N−A) nozzle groups of the first nozzle row are employed. In a second mode, B (A≠B) nozzle groups of N nozzle groups of the second nozzle row and (N−B) nozzle groups of the first nozzle row are employed.

7 Claims, 12 Drawing Sheets

IMAGE FORMING APPARATUS AND IMAGE FORMING METHOD

BACKGROUND

1. Technical Field

The present invention relates to an image forming apparatus, and an image forming method.

2. Related Art

As an image forming apparatus which ejects a liquid to form an image on a printing material, for example, an ink jet printer is known. In such a printer, a nozzle row formed by arranging a plurality of nozzles for ejecting a liquid is provided for each color of liquid. It is known that images are formed to overlap by partially using each nozzle row. For example, in WO2005/105452, a subsidiary image (for example, a background image) and a main image are formed to overlap on a printing material by using a nozzle row divided in half.

As described above, when viewing the image in which the main image and the subsidiary image are formed to overlap, the coloring property may be damaged according to a light state corresponding to a printed object. For example, when the front face (for example, a printing face) of the printing material is irradiated with light, as the subsidiary image (the background image) gets thicker, the coloring property of the main image printed thereon gets more satisfactory. However, when the back face (for example, the face opposite the printing face) of a printing material such as a printed object for illuminated advertising is irradiated with light and an image is viewed from the front side, the light is further blocked as a subsidiary image gets thicker, and thus the coloring property of the main image deteriorates.

SUMMARY

An advantage of some aspects of the invention is to improve the coloring property of a printed object.

According to an aspect of the invention, there is provided an image forming apparatus including: a nozzle row group that includes a first nozzle row in which a plurality of nozzles for ejecting a first liquid for forming a main image are arranged in a first direction, and a second nozzle row in which a plurality of nozzles for ejecting a second liquid for forming a subsidiary image assisting the main image are arranged in the first direction, the second nozzle row being provided in parallel to the first nozzle row in a second direction intersecting the first direction; and a control unit that performs a dot forming operation of ejecting a liquid from each nozzle to form dots on a printing material while moving the nozzle row group in the second direction, and a movement operation of moving at least one of the printing material and the nozzle row group in the first direction, to form an image on the printing material, wherein the control unit divides each of the first nozzle row and the second nozzle row into N (N is an integer equal to or more than 3) nozzle groups when the dot forming operation is performed, wherein in a first mode, A nozzle groups of N nozzle groups of the second nozzle row and (N−A) nozzle groups of the first nozzle row are employed to form the subsidiary image of A layers and the main image of (N−A) layers are formed to overlap on the printing material, and wherein in a second mode, B (A≠B) nozzle groups of N nozzle groups of the second nozzle row and (N−B) nozzle groups of the first nozzle row are employed to form the subsidiary image of B layers and the main image of (N−B) layers are formed to overlap on the printing material.

Other characteristics of the invention will be clarified by the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
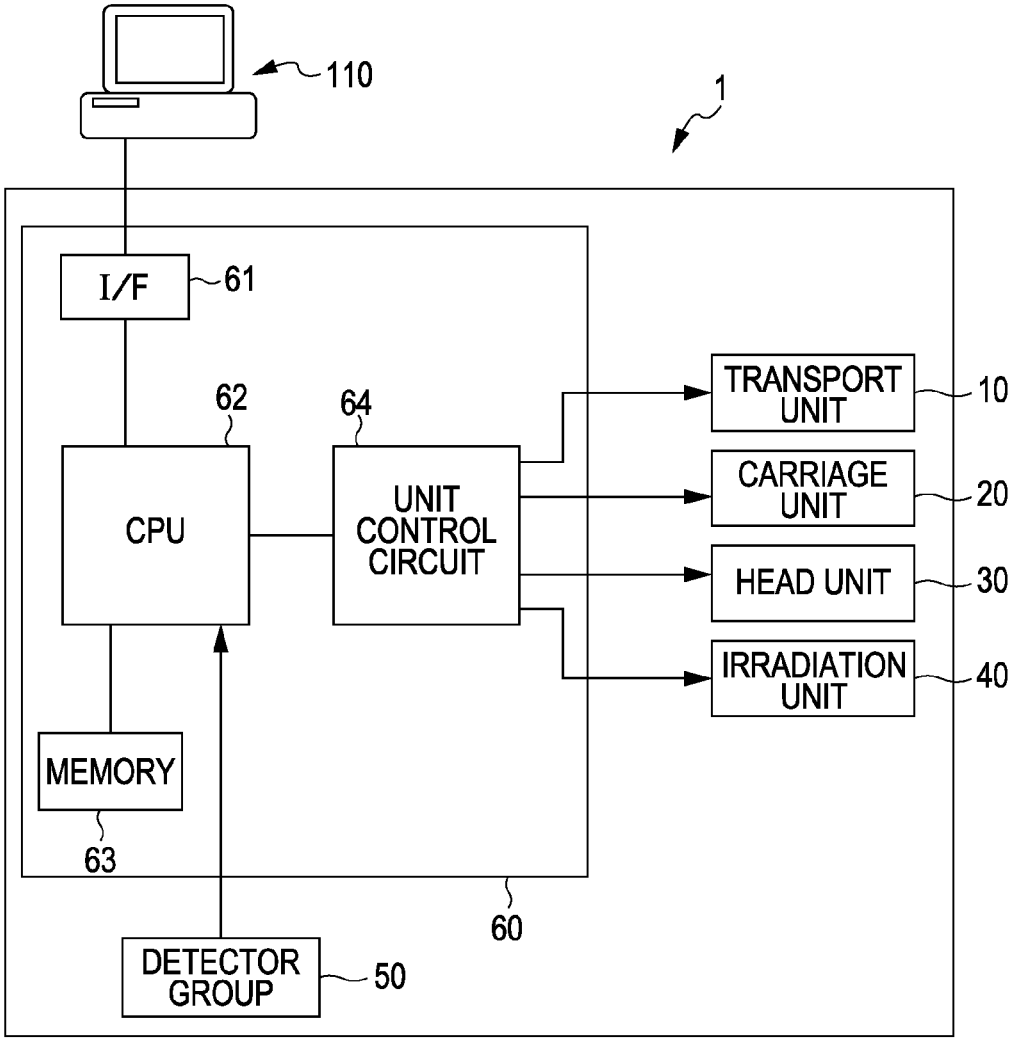
FIG. 1 is a block diagram illustrating a configuration of a printer.

At least the following items will be clarified by the description of the specification and the accompanying drawings.

There will be clarified an image forming apparatus including: a nozzle row group that includes a first nozzle row in which a plurality of nozzles for ejecting a first liquid for forming a main image are arranged in a first direction, and a second nozzle row in which a plurality of nozzles for ejecting a second liquid for forming a subsidiary image assisting the main image are arranged in the first direction, the second nozzle row being provided in parallel to the first nozzle row in a second direction intersecting the first direction; and a control unit that performs a dot forming operation of ejecting a liquid from each nozzle to form dots on a printing material while moving the nozzle row group in the second direction, and a movement operation of moving at least one of the printing material and the nozzle row group in the first direction, to form an image on the printing material, wherein the control unit divides each of the first nozzle row and the second nozzle row into N (N is an integer equal to or more than 3) nozzle groups when the dot forming operation is performed, wherein in a first mode, A nozzle groups of N nozzle groups of the second nozzle row and (N−A) nozzle groups of the first nozzle row are employed to form the subsidiary image of A layers and the main image of (N−A) layers are formed to overlap on the printing material, and wherein in a second mode, B (A≠B) nozzle groups of N nozzle groups of the second nozzle row and (N−B) nozzle groups of the first nozzle row are employed to form the subsidiary image of B layers and the main image of (N−B) layers are formed to overlap on the printing material.

According to such an image forming apparatus, the numbers of layers of the subsidiary image and the main image are changed in each mode, and thus it is possible to improve a coloring property of a printed object.

In the image forming apparatus, the first mode may be a mode in which one face of the printing material is irradiated with light to print a printed object for viewing an image on the one face side, and the second mode may be a mode in which the other face of the printing material is irradiated with light to print a printed object for viewing the image on the one face side.

According to such an image forming apparatus, it is possible to obtain a satisfactory coloring property irrespective of a light state corresponding to the printed object.

In the image forming apparatus, a value of A may be larger than a value of B.

According to such an image forming apparatus, it is possible to form the subsidiary image to be thick in the first mode, and it is possible to form the main image to be thick in the second mode. Accordingly, it is possible to improve a coloring property of a printed object formed in each mode.

In the image forming apparatus, a value of (N−B) may be equal to or larger than a value of B.

According to such an image forming apparatus, it is possible to make a coloring property of a printed object of the second mode more satisfactory.

In the image forming apparatus, in the first liquid, a dye may be used as a coloring agent, and in the second liquid, a pigment may be used as a coloring agent. In this case, it is possible to effectively improve a coloring property in particular.

In the image forming apparatus, the first liquid and the second liquid may be liquids cured by irradiation of light, and the image forming apparatus may further include an irradiation unit that irradiates the dots formed on the printing material by the first nozzle row and the second nozzle row, with the light.

According to such an image forming apparatus, it is possible to momentarily cure the dots after forming the dots, and thus it is possible to form an image with a thickness without depending on ink absorptiveness of the printing material. Accordingly, it is possible to reliably form the subsidiary image and the main image on the printing material to overlap in a plurality of layers.

There will be clarified an image forming method of forming an image on a printing material by an image forming apparatus including a nozzle row group that includes a first nozzle row in which a plurality of nozzles for ejecting a first liquid for forming a main image are arranged in a first direction, and a second nozzle row in which a plurality of nozzles for ejecting a second liquid for forming a subsidiary image assisting the main image are arranged in the first direction, the second nozzle row being provided in parallel to the first nozzle row in a second direction intersecting the first direction, the method including: dividing each the first nozzle row and the second nozzle row into N (N is an integer equal to or more than 3) nozzle groups; forming dots on a printing material by employing A nozzle groups of N nozzle groups of the second nozzle row and (N−A) nozzle groups of the first nozzle row in a first mode, and forming dots on the printing material by employing B (A≠B) nozzle groups of N nozzle groups of the second nozzle row and (N−B) nozzle group of the first nozzle row in a second mode, while moving the nozzle row group in the second direction; and moving at least one of the printing material or the nozzle row group in the first direction in the forming of the dots, wherein in the first mode, the subsidiary image of A layers and the main image of (N−A) layers are formed to overlap on the printing material, and in the second mode, the subsidiary image of B layers and the main image of (N−B) layers are formed to overlap on the printing material.

There will be clarified an image forming apparatus including: a nozzle row group that includes a first nozzle row in which a plurality of nozzles for ejecting a first liquid for forming a main image are arranged in a first direction, and a second nozzle row in which a plurality of nozzles for ejecting a second liquid for forming a subsidiary image assisting the main image are arranged in the first direction, the second nozzle row being provided in parallel to the first nozzle row in a second direction intersecting the first direction; and a control unit that performs a dot forming operation of ejecting a liquid from each nozzle to form dots on the printing material while moving the nozzle row group in the second direction, and a movement operation of moving at least one of the printing material and the nozzle row group in the first direction, to form an image on the printing material, wherein in a first mode, the control unit divides each of the first nozzle row and the second nozzle row into $N_1$ ($N_1$ is an integer equal to or more than 3) nozzle groups when the dot forming operation is performed, to form the subsidiary image and the main image together on the printing material to overlap in $N_1$ layers, and wherein in a second mode, the control unit divides each of the first nozzle row and the second nozzle row into $N_2$ ($N_2$ is an integer equal to or more than 2, and less than $N_1$) nozzle groups when the dot forming operation is performed, to form the subsidiary image and the main image together on the printing material to overlap in $N_2$ layers.

According to such an image forming apparatus, the numbers of overlaps (the number of layers) of the subsidiary image and the main image are changed in each mode, and thus it is possible to improve a coloring property of a printed object.

In the image forming apparatus, the first mode may be a mode in which one face of the printing material is irradiated with light to print a printed object for viewing an image on the one face side, and the second mode may be a mode in which the other face of the printing material is irradiated with light to print a printed object for viewing an image on the one face side.

According to such an image forming apparatus, it is possible to obtain a satisfactory coloring property irrespective of a light state corresponding to a printed object.

In the image forming apparatus, the number of layers of the subsidiary image in the $N_1$ layers may be larger than the number of layers of the subsidiary image in the $N_2$ layers.

According to such an image forming apparatus, in the first mode, the subsidiary image may be formed to be thick, and in the second mode, the subsidiary image may be formed to be thin. Accordingly, it is possible to improve a coloring property of a printed object formed in each mode.

In the image forming apparatus, in the first liquid, a dye may be used as a coloring agent, and in the second liquid, a pigment may be used as a coloring agent. In this case, it is possible to effectively improve particularly a coloring property.

In the image forming apparatus, the first liquid and the second liquid may be liquids cured by irradiation of light, and the image forming apparatus may further include an irradiation unit that irradiates the dots formed on the printing material by the first nozzle row and the second nozzle row, with the light.

According to such an image forming apparatus, it is possible to reliably form the subsidiary image and the main image on the printing material to overlap in a plurality of layers.

In addition, there will be clarified an image forming method of forming an image on a printing material by an image forming apparatus including a nozzle row group that includes a first nozzle row in which a plurality of nozzles for ejecting a first liquid for forming a main image are arranged in a first direction, and a second nozzle row in which a plurality of nozzles for ejecting a second liquid for forming a subsidiary image assisting the main image are arranged in the first direction, the second nozzle row being provided in parallel to the first nozzle row in a second direction intersecting the first direction, the method including: dividing each of the first nozzle row and the second nozzle row into $N_1$ ($N_1$ is an integer equal to or more than 3) nozzle groups in a first mode and dividing each of the first nozzle row and the second nozzle row into $N_2$ ($N_2$ is an integer equal to or more than 2, and less than $N_1$) nozzle groups in a second mode; ejecting a liquid from the nozzles of each nozzle group of the first nozzle row and the second nozzle row to form dots on the printing material while moving the nozzle row group in the second direction; and moving at least one of the printing material and the nozzle row group in the first direction in the dot forming process, wherein in the first mode, in a first mode, the subsidiary image and the main image are formed together on the printing material to overlap in $N_1$ layers, and wherein in a second mode, the subsidiary image and the main image are formed together on the printing material to overlap in $N_2$ layers.

In the following embodiments, as an image forming apparatus, an ink jet printer (hereinafter, referred to as a printer 1) will be described by way of example.

First Embodiment

Configuration of Printer

Figure 2:
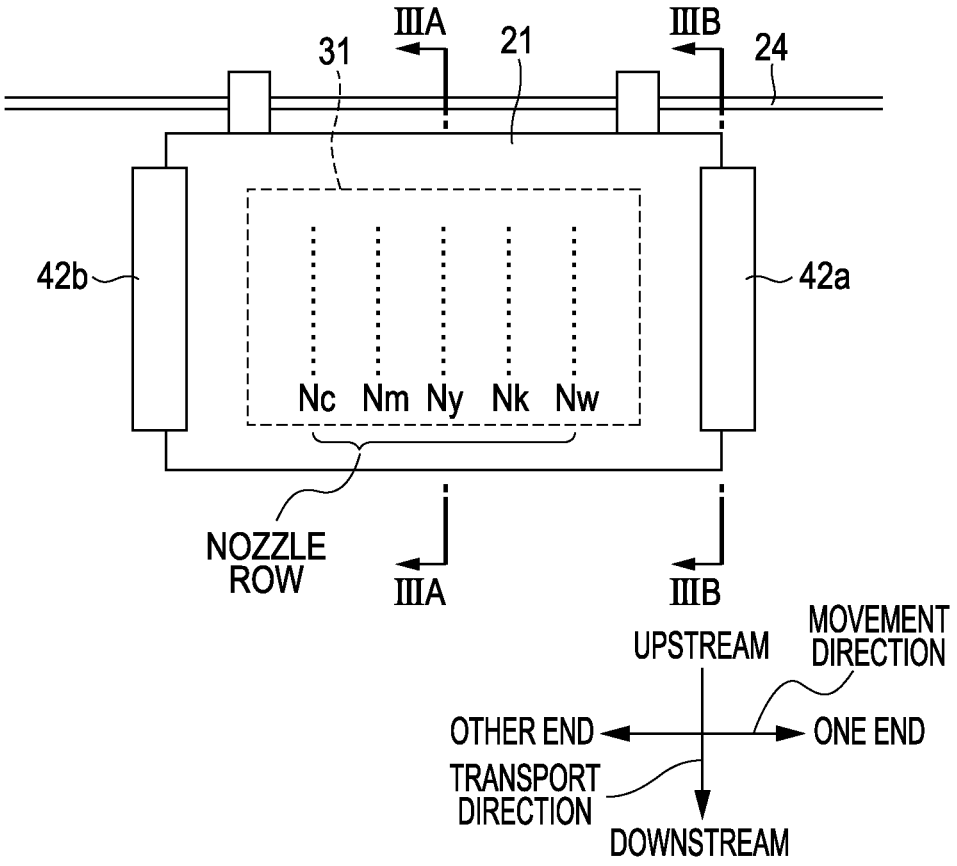
FIG. 2 is a schematic diagram illustrating a head circumference of a printer.
Figure 3A:
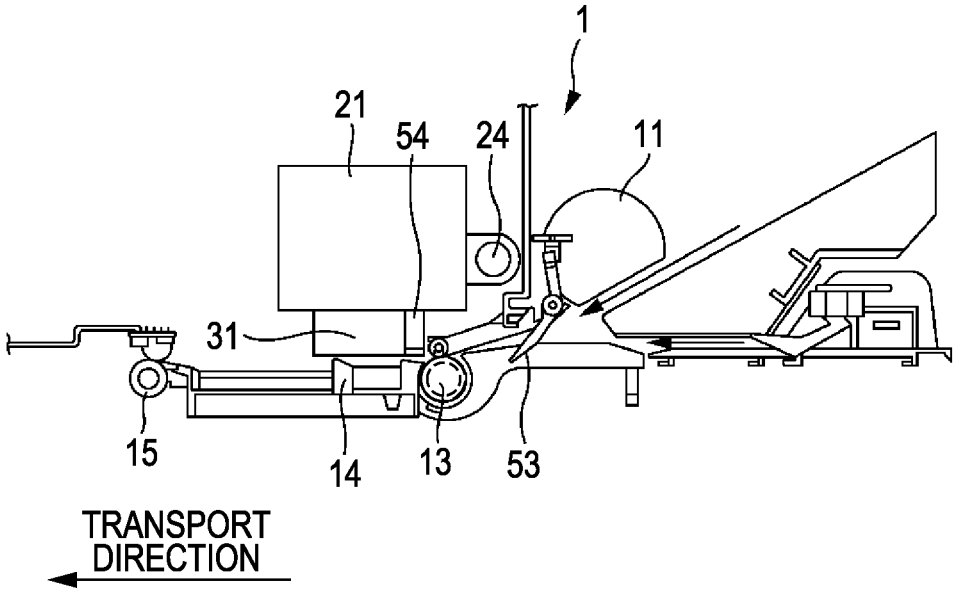
FIG. 3A and FIG. 3B is a transverse cross-sectional view of a printer.
Figure 3B:
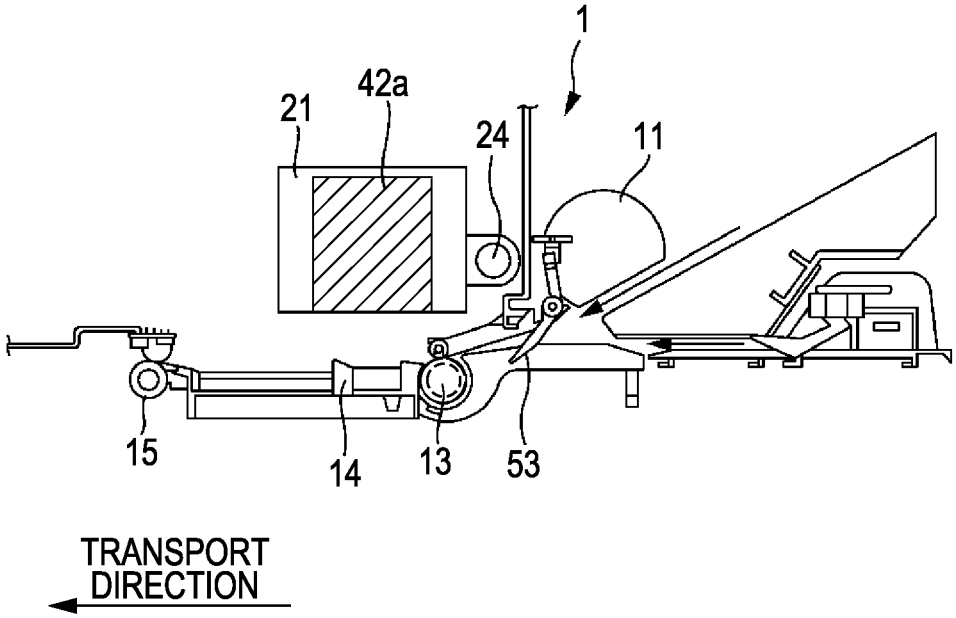

Hereinafter, a printer 1 according to an embodiment of the invention will be described with reference to FIG. 1, FIG. 2, FIG. 3A, and FIG. 3B. FIG. 1 is a block diagram illustrating a configuration of the printer 1. FIG. 2 is a schematic diagram illustrating a head circumference of the printer 1. FIG. 3A and FIG. 3B are transverse cross-sectional views of the printer 1. FIG. 3A corresponds to a cross-section of IIIA-IIIA of FIG. 2, and FIG. 3B corresponds to a cross-section of IIIB-IIIB of FIG. 2.

The printer 1 is an apparatus which ejects an ultraviolet curable ink (hereinafter, referred to as UV ink) cured by irradiation of ultraviolet light (UV) that is a kind of light as an example of a liquid to a printing material such as paper, cloth, film sheet, and the like, to print an image on the printing material. The UV ink is ink including ultraviolet curable resin. When the UV ink is irradiated with UV, a photo polymerization reaction occurs in the ultraviolet curable resin, and thus the UV ink is cured. In addition, the printer 1 performs printing using the four CMYK colors of UV ink (color ink) and white ink for background to be described later.

The printer 1 includes a transport unit 10, a carriage unit 20, a heat unit 30, and an irradiation unit 40, a detector group 50, and a controller 60. The printer 1 receiving printing data from a computer 110 that is an external apparatus controls the units (the transport unit 10, the carriage unit 20, the head unit 30, and the irradiation unit 40) by the controller 60. The controller 60 controls the units to print an image on the printing material on the basis of the printing data received from the computer 110. The state in the printer 1 is being monitored by the detector group 50, and the detector group 50 outputs a detection result to the controller 60. The controller 60 controls the units on the basis of the detection result output from the detector group 50.

The transport unit 10 transports the printing material (for example, a vinyl chloride film) in a predetermined direction (hereinafter, referred to as a transport direction). The transport unit 10 includes a sheet feeding roller 11, a transport motor (not shown), a transport roller 13, a platen 14, and a sheet discharge roller 15. The sheet feeding roller 11 is a roller for feeding the printing material inserted into a paper insertion port, into the printer. The transport roller 13 is a roller that transports the printing material fed by the sheet feeding roller 11 to a printable area, and is driven by the transport motor. The platen 14 supports the printing material that is being printed. The sheet discharge roller 15 is a roller that discharges the printing material to the outside of the printer, and is provided on the downstream side in the transport direction in the printable area.

The carriage unit 20 moves (also referred to as "scans") the head in a direction (hereinafter, referred to as a movement direction) intersecting the transport direction. In addition, the intersection direction is generally a perpendicular direction. The carriage unit 20 has a carriage 21 and a carriage motor (not shown). In addition, the carriage 21 detachably keeps an ink cartridge that accommodates the UV ink. The carriage 21 reciprocally moves along a guide shaft 24 by the carriage motor with the carriage 21 supported by the guide shaft 24 intersecting the transport direction to be described later.

The head unit 30 ejects a liquid (the UV ink in the embodiment of the invention) to the printing material. The head unit 30 is provided with a head 31 having a plurality of nozzles. The head 31 is provided in the carriage 21. Accordingly, when the carriage 21 is moved in the movement direction, the head 31 is also moved in the movement direction. The head 31 discontinuously ejects the UN ink during movement in the movement direction, to form a dot line (a raster line) along the movement direction on the printing material. In addition, in the following description, a path of moving from one end side to the other end side in the movement direction shown in FIG. 2 is called a forward path, and a path of moving from the other end side to one end side in the movement direction is called a backward path. In the printer 1, the UV ink is ejected from the head 31 in both periods of the forward path and the backward path. That is, the printer 1 performs two-way printing.

In addition, a configuration of the head 31 will be described later.

The irradiation unit 40 irradiates the UV ink landing onto the printing material with the UV. The dots formed on the printing material are cured by irradiation of UV from the irradiation unit 40. The irradiation unit 40 is provided with an irradiation unit 42*a* and 42*b*. In addition, the irradiation units 42*a* and 42*b* are provided in the carriage 21. For this reason, when the carriage 21 is moved in the movement direction, the irradiation units 42*a* and 42*b* are moved in the movement direction.

The irradiation units 42*a* and 42*b* are provided on one end side and the other end side in the movement direction on the carriage 21, with the head 31 interposed therebetween. The length of the irradiation unit 42*a* and 42*b* in the transport direction is substantially equal to or longer than the length of the nozzle row of the head 31. In other words, the irradiation units 42*a* and 42*b* are provided at a position arranged in the movement direction with the nozzle rows of the head 31. The irradiation units 42*a* and 42*b* move with the head 31, and irradiate with UV a range where the nozzle row of the head 31 forms dots. In addition, as a light source of UV irradiation of the irradiation units 42*a* and 42*b*, a metal halide lamp, and a light emitting diode (LED), or the like is used. When the light source is an LED, it is possible to easily change irradiation energy of UV by controlling the magnitude of input current. Although not shown, the irradiation unit 42*a* and 42*b* are provided with a plurality of LEDs along the transport direction, and it is possible to set the irradiation range (the range in the transport direction) of UV by controlling the turning on and off of the LEDs. For example, when a half of nozzles on the downstream side in the transport direction in the nozzle rows of the head 31 are used, it is possible to irradiate the range where the half of nozzles form the dots, with UV. In such a manner, it is possible to efficiently irradiate the dots formed on the printing material with UV, and thus it is possible to reduce energy consumption.

The detector group 50 includes a linear encoder (not shown), a rotary encoder (not shown), a paper detection sensor 53, an optical sensor 54, and the like. The linear encoder detects a position of the carriage 21 in the movement direction. The rotary encoder detects the amount of rotation of the transport roller 13. The paper detection sensor 53 detects a position of a leading end of the printing material that is being fed. The optical sensor 54 detects whether or not the printing material is present by a light emitting unit and a light receiving unit provided in the carriage 21. The optical sensor 54 detects a position of an end portion of the printing material while moving by the carriage 21, to detect the width of the printing material. The optical sensor 54 may also detect the leading end (referred to as an end portion on the downstream side in the transport direction, and also an upper end) and the trailing end (referred to as an end portion on the upstream side in the transport direction, and also a lower end) of the printing material according to a situation.

The controller 60 is a control unit that controls the printer 1. The controller 60 includes an interface unit 61, a CPU (a Central Processing Unit) 62, and a memory 63, and a unit control circuit 64. The interface unit 61 performs transmission and reception of data between the computer 110 that is the external apparatus and the printer 1. The CPU 62 is an operation processing device that controls the whole of the printer 1. The memory 63 secures an area where a program of the CPU 62 is stored, a work area, or the like, and includes storage elements such as a RAM (Random Access Memory), an EEPROM (an Electrically Erasable Programmable Read-Only Memory), and the like. The CPU 62 controls the units through the unit control circuit 64 according to the program stored in the memory 63.

When the printing is performed, to be described later, the controller 60 repeatedly performs a dot forming operation of ejecting the UV ink from the head 31 moving in the forward direction and the backward direction, and a transport operation of transporting the sheet in the transport direction, to print an image formed of a plurality of dots on the sheet. In addition, in the following description, the dot forming operation is referred to as "a pass". In addition, the n-th pass is referred to as a pass n. In addition, at the time of pass, UV irradiation is performed by the irradiation units 42*a* and 42*b* to be described later.

Configuration of Head 31

Figure 4:
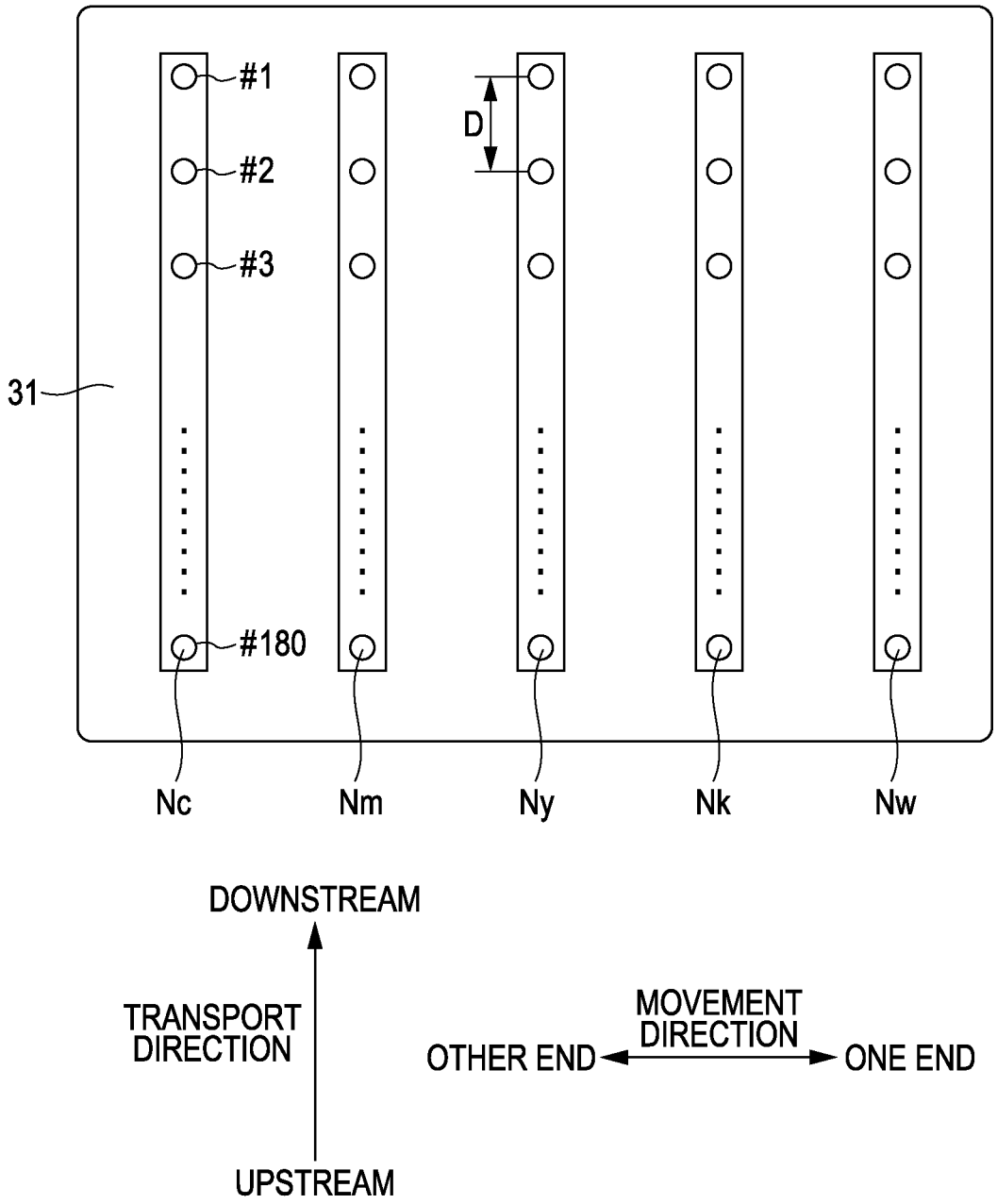
FIG. 4 is a diagram illustrating a configuration of a head.

FIG. 4 is a diagram illustrating an example of a configuration of the head 31. In addition, FIG. 4 is a diagram when the head 31 is viewed from below (that is, from the platen 14 side). As shown in FIG. 4, a cyan ink nozzle row Nc, a magenta ink nozzle row Nm, a yellow ink nozzle row Ny, a black ink nozzle row Nk, and a white ink nozzle row Nw are formed on the lower face of the head 31. Each nozzle row has a plurality of nozzles (for example 180) for ejecting each color of UV ink. In addition, as shown in FIG. 4, each nozzle row is provided to be arranged in the movement direction. In the following description, the cyan ink is referred to as C, the magenta ink is referred to as M, the yellow ink is referred to as Y, the black ink is referred to as K, and the white ink is referred to as W. In addition, the C ink, the M ink, the Y ink, and the K ink are referred to as color ink (corresponding to a first liquid), each nozzle row for ejecting such color ink is referred to as a color ink nozzle row (corresponding to a first nozzle row). In addition, an image formed by such color ink is referred to as a color image (corresponding to a main image). In addition, in the color ink, a dye is used as a coloring agent.

In addition, the white ink nozzle row Nw for ejecting the W ink (corresponding to a second liquid) corresponds to a second nozzle row, and an image formed by the W ink is referred to a background image. The W ink is the white ink for printing the background color of the color image when the printing is performed on the printing material, and a pigment such as titanium oxide is used as a coloring agent. In addition, generally, transmittance of light for the pigment-based ink is lower than that for the dye-based ink. That is, transmittance of light for the W ink is lower than that for the color ink.

The background is white using the W ink, and thus the color image formed to overlap is easily viewed. That is, the white background image corresponds to a subsidiary image assisting the color image (the main image). In addition, "white" is not limited to strictly meaning white that is a surface color of an object, which reflects all wavelengths of visible light by 100%, and may include a color called white under common social convention, such as so-called "off-white".

The plurality of nozzles of each nozzle row are arranged at a regular distance (a nozzle pitch: D) along the transport direction. The further the nozzle in each nozzle row is in the downstream direction, the smaller the number applied/given thereto. Such a nozzle is provided with a piezoelectric element (not shown) as a driving element for ejecting the UV ink from each nozzle. By driving the piezoelectric element according to a driving signal, guttate UV ink is ejected from each nozzle. The ejected UV ink lands on the printing material to form dots.

Front Light and Back Light

As a printed object, there is a printed object for which one face (for example, a printing face: hereinafter, referred to as the front face) of the printing material is irradiated with light to view an image on the front side, and a printed object for which the other face (for example, a back face of the printing face) of the printing material is irradiated with light to view an image on the front side (for example, a printed object for illuminated advertising). In addition, in the following description, the light irradiated on the front face is referred to as front light, and the light irradiated on the back face is referred to as back light.

Figure 5A:
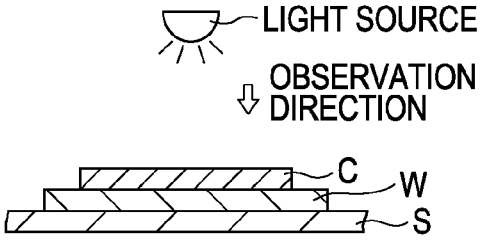
FIG. 5A is a schematic diagram illustrating a case where an image is viewed with front light.
Figure 5B:
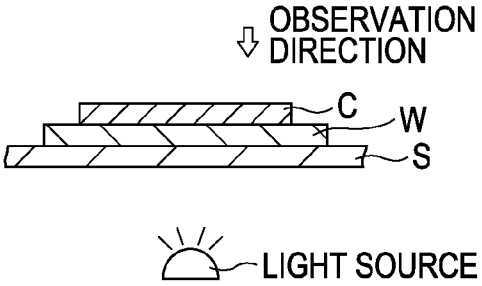
FIG. 5B is a schematic diagram illustrating a case where an image is viewed with back light.

FIG. 5A is a schematic diagram illustrating a case where an image is viewed with the front light, and FIG. 5B is a schematic diagram illustrating a case where an image is viewed with the back light.

In FIG. 5A and FIG. 5B, on the printing material S (for example, a transparent film), the white background image W is formed, and the color image C is formed to overlap thereon. In addition, the printer 1 uses the UV ink, and performs UV irradiation immediately after the forming of dots to cure the dots, to be described later. As described above, it is possible to momentarily cure the dots by the UV irradiation, and thus it is possible to form an image with a thickness without depending on ink absorptiveness of the printing material S. That is, it is possible to form the background image W and the color image C on the printing material S to overlap in a plurality of layers.

In FIG. 5A, a light source is provided on the printing face side, and the printing material S is irradiated with light (front light) from the light source. In such a manner, the images (the color image C and the background image W) on the printing material S are recognized by a viewer on the printing face side.

Meanwhile, in FIG. 5B, the light source is provided on the back side of the printing face, and a printing material S is irradiated with light (the back light) from the light source. The light passes through the printing material S and the images (the color image C and the background image W), and thus the images on the printing material S are recognized by the viewer on the printing face side.

Overlap Printing

In FIG. 5A and FIG. 5B, each of the background image W and the color image C is formed by one layer. However, by increasing the number of overlap (the number of layers) of the images, it is possible to improve a coloring material of the printed object (more specifically, the color image C). For example, when the background image W is printed to overlap by two layers and the color image C is formed thereon, and when the image is viewed by the front light, the white color of the background become thick, and thus the coloring property of the color image C becomes satisfactory. However, when the image is viewed by the back light as shown in FIG. 5B, the light of the back light is blocked by the background image W (the W ink with low light transmittance) of the 2 layers, the amount of transmittance (light quantity) is decreased, and thus the coloring property of the color image C deteriorates. Particularly, a pigment with low light transmittance is used in the W ink. Accordingly, when the background image W becomes thick, the coloring property of the color image C significantly deteriorates.

As described above, when the color image C and the background image W are formed to overlap, the coloring property in a state of light corresponding to the printed object may be damaged.

Therein, as described below, in the printer 1, two printing modes of a first mode of printing an image viewed by the front light and a second mode of printing an image viewed by the back light are performed. In the first mode and the second mode, the number of overlaps (the number of layers) of the color image C and the background image W is changed to improve the coloring property of the printed object.

Printing Process

Printing Process of First Mode

First, the printing process of the first mode will be described.

Figure 6:
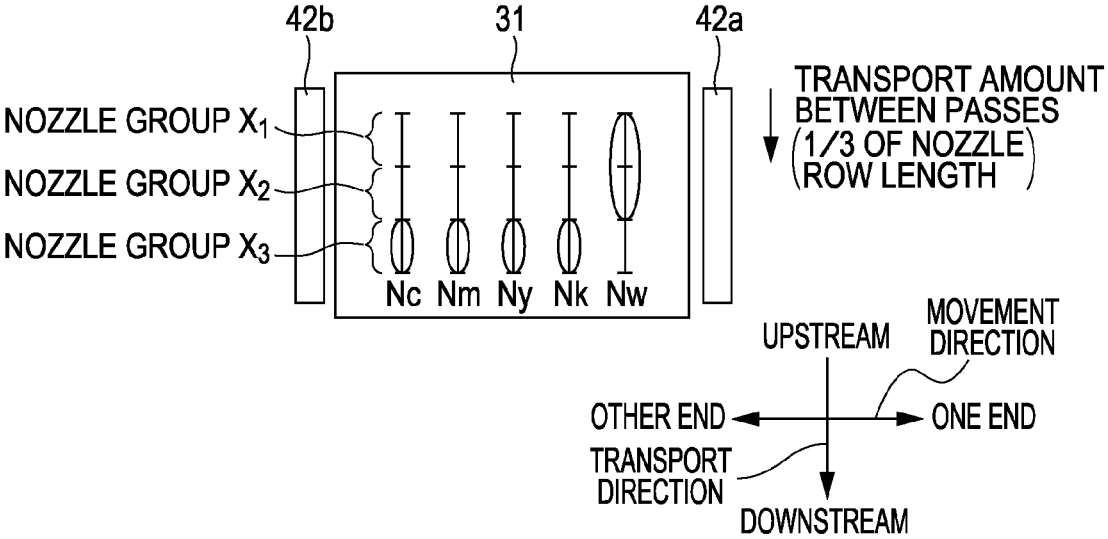
FIG. 6 is a diagram illustrating setting of nozzle groups when performing a printing process of a first mode according to a first embodiment.

FIG. 6 is a diagram illustrating setting of nozzle groups when performing a printing process of a first mode according to the first embodiment. In FIG. 6, for convenience of description, each nozzle row of the head 31 is indicated by a straight line. When the printing of the first mode is performed, the controller 60 uniformly divides and uses each nozzle row of the head 31 into 3 parts (that is, 3 uniform part division). The 3-divided groups of nozzles are a nozzle group $X_1$, a nozzle group $X_2$, and a nozzle group $X_3$ sequentially from the upstream side in the transport direction. For example, when the number of nozzles of each nozzle row is 180, the nozzle group $X_1$ is nozzle numbers #121 to #180, the nozzle group $X_2$ is nozzle numbers #61 to #120, and the nozzle group $X_3$ is nozzle numbers #1 to #60.

In FIG. 6, the nozzle group used in the printing of the first mode in the nozzle rows is surrounded with a circle for indication. For example, in the white ink nozzle row Nw, the nozzle group $X_1$ and the nozzle group $X_2$ are used. In addition, in the color ink nozzle row, the nozzle group $X_3$ is used.

Figure 7A:
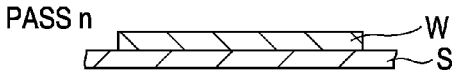
FIG. 7A to FIG. 7C are schematic diagrams sequentially illustrating formation of an image in the first mode.
Figure 7B:
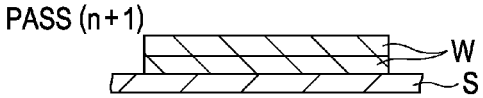
Figure 7C:
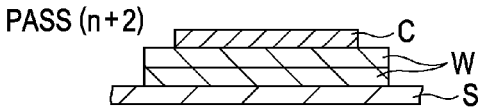

FIG. 7A to FIG. 7C are schematic diagrams sequentially illustrating formation of an image in the first mode. In the printing area of the printer 1, the printing material S has been transported already, and thus an image is not yet formed on the printing material S at a position opposed to the nozzle group $X_1$.

First, the controller 60 ejects ink from each nozzle of the head 31 while moving the carriage 21 in the movement direction (the forward direction), in the pass n (for example, the forward path). In this case, as shown in FIG. 6, the controller 60 ejects the W ink from the nozzle group $X_1$ and the nozzle group $X_2$ of the white ink nozzle row Nw of the head 31. In addition, the controller 60 ejects the color ink from the nozzle groups $X_3$ of the color ink nozzle rows (Nc, Nm, Ny, and Nk) of the head 31. Accordingly, on the printing material S at the position opposed to the nozzle group $X_1$, the W ink is ejected from the white ink nozzle row Nw, and the background image W is formed as shown in FIG. 7A. In addition, the controller 60 irradiates UV from the irradiation unit 42*a* on the upstream side in the movement direction. Accordingly, the background image W formed on the printing material S is immediately cured.

After the pass n, the controller 60 transports the printing material S to the downstream side in the transport direction by the transport amount of ⅓ (that is, the length of the nozzle group) of the nozzle row length (the transport operation). The printing material S moves by ⅓ of the nozzle row length to the downstream side in the transport direction. Accordingly, the background image W of FIG. 7A is transported to a position opposed to the nozzle group $X_2$ by the transport operation. In addition, by the transport operation, the printing material S on which an image is not yet formed is transported to the position opposed to the nozzle group $X_1$.

After the transport operation, the controller 60 performs the pass (n+1). The printer 1 performs the two-way printing. Accordingly, when the pass n is the forward pass, the pass (n+1) is the backward pass.

The controller 60 ejects the UV ink from the nozzles of the head 31 while moving the carriage 21 in the movement direction (the backward direction). In this case, the controller 60 ejects the W ink from the nozzles of the nozzle group $X_1$ and the nozzle group $X_2$ of the white ink nozzle row Nw of the head 31 similarly to the case of the pass n. In addition, the color ink is ejected from the nozzle group $X_3$ of the color ink nozzle rows (Nc, Nm, Ny, and Nk) of the head 31. Accordingly, the W ink is ejected from the nozzle group $X_2$ of the white ink nozzle row Nw onto the background image W transported to the position opposed to the nozzle group $X_2$, and thus the background image W is formed to overlap as shown in FIG. 7B. That is, the 2-layer background image W is formed.

In addition, the controller 60 irradiates UV from the irradiation unit 42*b* on the upstream side in the movement direction of the head 31 in the pass (n+1). As described above, in the pass (n+1), the movement direction is reverse to that of the pass n, and thus the irradiation unit used in the UV irradiation is different from that case of the pass n.

After the pass (n+1), the controller 60 transports the printing material S to the downstream side in the transport direction by the transport amount of ⅓ (that is, the length of the nozzle group) of the nozzle row length (transport operation). The printing material S is moved to the downstream side in the transport direction by ⅓ of the nozzle row length, and thus the 2-layer background image W shown in FIG. 7B is transported to the position opposed to the nozzle group $X_3$ by this transport operation.

Thereafter, the controller 60 performs the pass (n+2). In the pass (n+2), the controller 60 ejects ink from each nozzle of the head 31 while moving the carriage 21 in the movement direction (the forward direction). Even in this pass, the controller 60 ejects the W ink from the nozzle group $X_1$ and the nozzle group $X_2$ of the white ink nozzle row Nw of the head 31. In addition, each color ink is ejected from the nozzle group $X_3$ of the color ink nozzle rows (Nc, Nm, Ny, and Nk) of the head 31. Accordingly, the color ink is ejected from the nozzle group $X_3$ of the color ink nozzle row onto the 2-layer background image W transported to the position opposed to the nozzle group $X_3$. In such a manner, as shown in FIG. 7C, the 2-layer background image W and the 1-layer color image C are formed to overlap.

In the pass (n+2), the controller 60 irradiates UV from the irradiation unit 42*a* on the upstream side in the movement direction of the head 31.

After the pass (n+2), the controller 60 transports the printing material S to the downstream side in the transport direction by the transport amount of ⅓ (that is, the length of each nozzle group) of the nozzle row length (transport operation). By this transport operation, the image shown in FIG. 7C is transported to an area (the downstream side in the transport direction from the head 31) other than the printing area, and the printing material S on which an image is not yet formed is transported to the upstream side in the transport direction of the printing area.

Hereinafter, similarly, the controller 60 alternately and repeatedly performs the pass and the transport operation. Accordingly, the images (the 2-layer background image W and the 1-layer color image C) are sequentially printed on the printing material S.

Printing Process of Second Mode

Next, the printing process of the second mode will be described.

Figure 8:
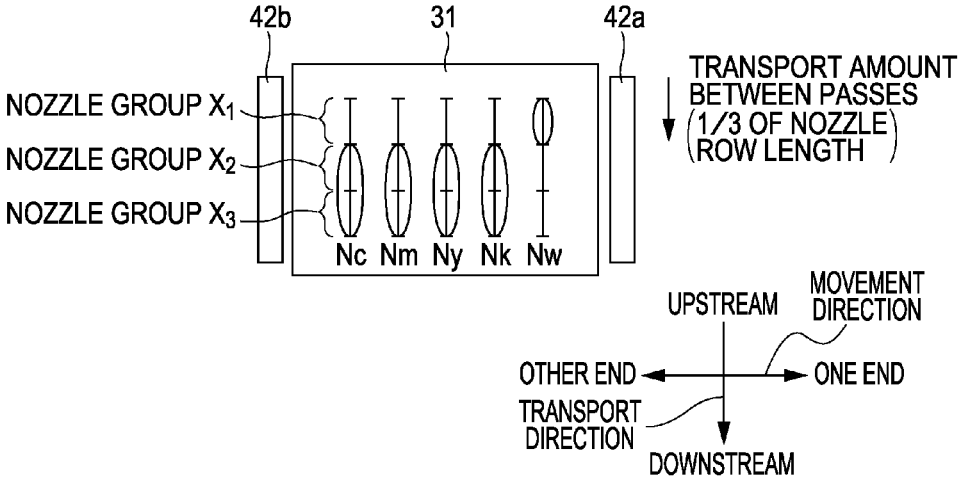
FIG. 8 is a diagram illustrating setting of nozzle groups when performing a printing process of a second mode according to the first embodiment.

FIG. 8 is a diagram illustrating setting of nozzle groups when performing a printing process of a second mode according to the first embodiment. Even when the printing of the second mode is performed, the controller 60 divides uses each nozzle row of the head 31 into 3 uniform parts, similarly to the first mode. However, the used nozzle group is different from the case (FIG. 6) of the printing of the first mode. For example, in the white ink nozzle row Nw, only the nozzle group $X_1$ is used. In addition, in the color ink nozzle row, the nozzle group $X_2$ and the nozzle $X_3$ are used.

Figure 9A:
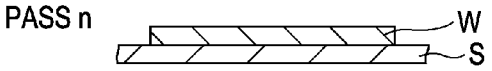
FIG. 9A to FIG. 9C are schematic diagrams sequentially illustrating formation of an image in the second mode.
Figure 9B:
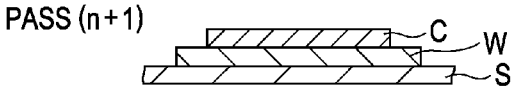
Figure 9C:
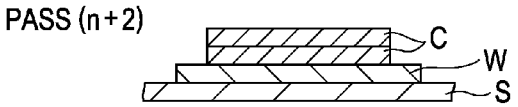

FIG. 9A to FIG. 9C are schematic diagrams sequentially illustrating formation of an image in the second mode. In addition, in the printing area of the printer 1, the printing material S has been already transported, and an image is not yet formed on the printing material S at the position opposed to the nozzle group $X_1$.

First, in the pass n (for example, the pass of the forward pass), the controller 60 ejects ink from each nozzle of the head 31 while moving the carriage 21 in the movement direction (the forward direction). In this case, as shown in FIG. 8, the controller 60 ejects the W ink from the nozzles of the nozzle group $X_1$ of the white ink nozzle row Nw of the head 31. In addition, the color ink is ejected from the nozzle group $X_2$ and the nozzle group $X_3$ of the color ink nozzle rows (Nc, Nm, Ny, and Nk) of the head 31. Accordingly, the W ink is ejected from the white ink nozzle row Nw onto the printing material S at the position opposed to the nozzle group $X_1$, and thus the background image W is formed as shown in FIG. 9A. In addition, the controller 60 irradiates UV from the irradiation unit 42*a* on the upstream side in the movement direction. Accordingly, the background image W formed on the printing material S is immediately cured.

After the pass n, the controller 60 transports the printing material S to the downstream side in the transport direction by the transport amount of ⅓ (that is, the length of the nozzle group) of the nozzle row length. The printing material S is moved to the downstream side in the transport direction by ⅓ of the nozzle row length, and thus the background image W shown in FIG. 9A is transported to the position opposed to the nozzle group $X_2$ by this transport operation. In addition, the printing material S on which an image is not yet formed is transported to the upstream side in the transport direction of the printing area by this transport operation.

After the transport operation, the controller 60 performs the pass (n+1). The printer 1 performs the two-way printing. Accordingly, when the pass n is the forward pass, the pass (n+1) is the pass of the forward path.

The controller 60 ejects the UV ink from the nozzles of the head 31 while moving the carriage 21 in the movement direction (the backward direction). In this case, the controller 60 ejects the W ink from the nozzles of the nozzle group $X_1$ of the white ink nozzle row Nw of the head 31, similarly to the time of the pass n. In addition, the color ink is ejected from the nozzle group $X_2$ and the nozzle group $X_3$ of the color ink nozzle rows (Nc, Nm, Ny, and Nk) of the head 31. Accordingly, the color ink is ejected from the nozzle group $X_2$ of the color ink nozzle row onto the background image W shown in FIG. 9A, and the color image C is formed to overlap on the background image W as shown in FIG. 9B.

In addition, the controller 60 irradiates UV from the irradiation unit 42*b* on the upstream side in the movement direction of the head 31 in the pass (n+1). As described above, in the pass (n+1), the movement direction is reverse to that of the pass n, and thus the irradiation unit used in the UV irradiation is different from the case of the pass n.

After the pass (n+1), the controller 60 transports the printing material S to the downstream side in the transport direction by the transport amount (that is, the length of each nozzle group) of ⅓ of the nozzle row length (transport operation). The printing material S is moved to the downstream side in the transport direction by ⅓ of the nozzle row length, and thus the background image W and the color image C shown in FIG. 9B are transported to the position opposed to the nozzle group $X_3$ by this transport operation.

Thereafter, the controller 60 performs the pass (n+2). In the pass (n+2), the controller 60 ejects ink from the nozzles of the head 31 while moving the carriage 21 in the movement direction (the forward direction). Even in this pass, the controller 60 ejects the W ink from the nozzles of the nozzle group $X_1$ of the white ink nozzle row Nw of the head 31. In addition, the color ink is ejected from the nozzle group $X_2$ and the nozzle group $X_3$ of the color ink nozzle rows (Nc, Nm, Ny, and Nk) of the head 31. Accordingly, the color ink is ejected from the color ink nozzle row onto the color image C shown in FIG. 9B. In such a manner, as shown in FIG. 9C, the 1-layer background image W and the 2-layer color image C are formed to overlap.

The controller 60 irradiates UV from the irradiation unit 42*a* on the upstream side in the movement direction of the head 31 in the pass (n+2).

After the pass (n+2), the controller 60 transports the printing material S to the downstream side in the transport direction by the transport amount of ⅓ (that is, the length of each nozzle group) of the nozzle row length (the transport operation). By this transport operation, the image of FIG. 9C is transported to an area (the downstream side in the transport direction from the head 31) other than the printing area. In addition, the printing material S on which an image is not yet formed is transported to the upstream side in the transport direction of the printing area.

Hereafter, similarly, the controller 60 alternately and repeatedly the pass and the transport operation. Accordingly, the images are sequentially printed on the printing material S.

Printed Object

Figure 10A:
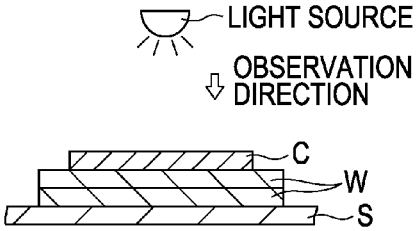
FIG. 10A is a diagram illustrating a printed object printed in the first mode in the first embodiment.
Figure 10B:
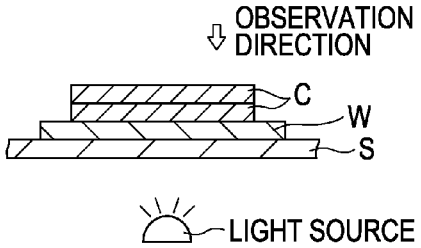
FIG. 10B is a diagram illustrating a printed object printed on the second mode in the first embodiment.

FIG. 10A is a diagram illustrating a printed object printed in the first mode in the first embodiment, and FIG. 10B is a diagram illustrating a printed object printed on the second mode in the first embodiment.

As shown in FIG. 10A, the printed object printed in the printing process of the first mode, the 2-layer background image W and the 1-layer color image C are formed to overlap on the printing material S. When the printed object is irradiated with the front light, the background image W is printed to be thick. Accordingly, the coloring property of the color image C is satisfactory, and the color image C is easily viewed.

Meanwhile, as shown in FIG. 10B, in the printed object printed in the printing process of the second mode, the 1-layer background image W and the 2-layer color image C are formed to overlap on the printing material S. That is, the background image W is thinner than that of the printed object of the first mode. When the printed object is irradiated with the back light, the light more easily passes through as compared with the case where the printed object is irradiated with the back light in the first mode, the color image C is formed in two layers, and thus the coloring property of the color image C is satisfactory.

As described above, in the printer 1 of the first embodiment, each nozzle row of the head 31 is divided into three nozzle groups. In the mode (the first mode) of printing the image viewed by the front light and in the mode (the second mode) of printing the image viewed by the back light, by changing the used nozzle group, in the first mode, the 2-layer background image W and the 1-layer color image C are formed to overlap on the printing material S, and in the second mode, the 1-layer background image W and the 2-layer color image C are formed to overlap on the printing material S. In such a manner, it is possible to improve the coloring property of the printed object in each mode.

In addition, in the second mode, the number of used nozzle groups of the color ink nozzle row for ejecting the color ink (the dye ink) is larger than the number of used nozzle groups of the white ink nozzle row Nw for ejecting the W ink (the pigment ink). Accordingly, it is possible to form the background image W to be thin and to form the color image to be thick. Accordingly, when the image is viewed by the back light, the light easily passes through the image, and the color image C becomes thick. Accordingly, it is possible to improve the coloring property.

Second Embodiment

In a second embodiment, the number of division of nozzles of the head 31 is different from that of the first embodiment. In addition, a configuration of the printer 1 is the same as that of the first embodiment, and thus the description thereof is not repeated.

Figure 11A:
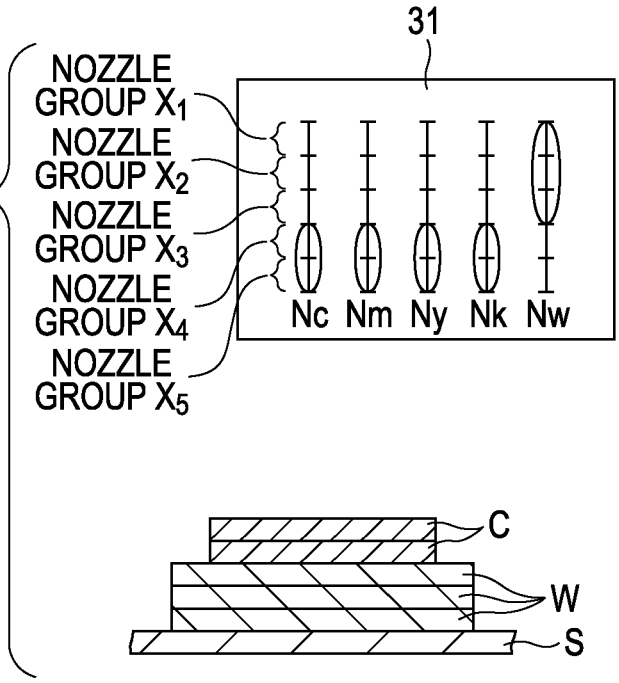
FIG. 11A is a diagram illustrating setting of nozzle groups of a first mode and a printed object in a second embodiment.
Figure 11B:
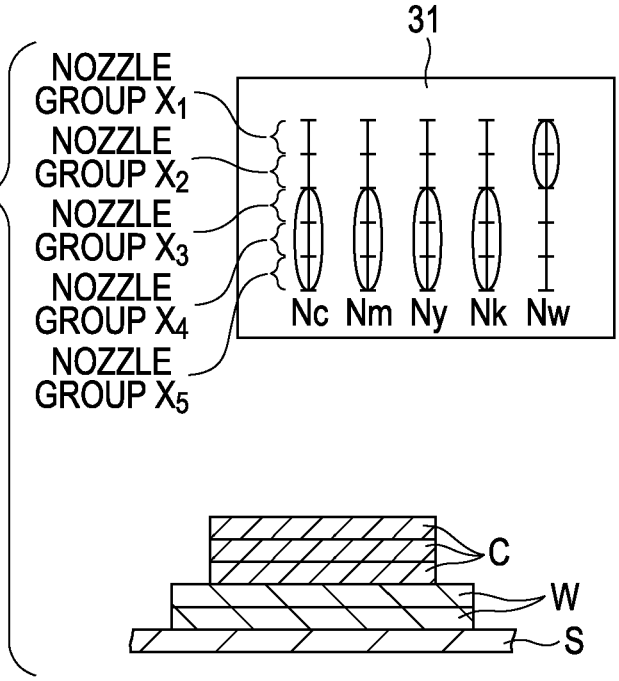
FIG. 11B is a diagram illustrating setting of nozzle groups of a second mode and a printed object in the second embodiment.

FIG. 11A is a diagram illustrating setting of nozzle groups of a first mode and a printed object in a second embodiment, and FIG. 11B is a diagram illustrating setting of nozzle groups of a second mode and a printed object in a second embodiment. In addition, in FIG. 11A and FIG. 11B, the upper figure represents setting of nozzle groups in each mode, and the lower figure represents a printed object formed by printing of each mode.

In the second embodiment, as FIG. 11A and FIG. 11B, each nozzle row of the head 31 is divided into five nozzle groups ($X_1$ to $X_5$) (5 uniform division). In addition, in FIG. 11A and FIG. 11B, the nozzle group used in each printing mode is surrounded with a circle. For example, in a case of the first mode (FIG. 11A), in the white ink nozzle row Nw, three nozzle groups of the nozzle group $X_1$, the nozzle group $X_2$, and the nozzle group $X_3$ are used, and in the color ink nozzle row, two nozzle groups of the nozzle group $X_4$ and the nozzle group $X_5$ are used. Meanwhile, in a case of the second mode (FIG. 11B), in the white ink nozzle row Nw, two nozzle groups of the nozzle group $X_1$ and the nozzle group $X_2$ are used, and in the color ink nozzle row, three nozzle groups of the nozzle group $X_3$, the nozzle group $X_4$, and the nozzle group $X_5$ are used.

Even in the second embodiment, the pass and the transport operation are repeatedly performed similarly to the first embodiment, to form an image on the printing material S. However, the transport amount based on the transport operation between the passes is determined according to the number of division of the nozzle rows. For example, when the nozzle row is divided into n parts, the transport amount of the transport operation is 1/n of the nozzle row length. In the second embodiment, the nozzle row is divided into five parts, and thus the transport amount of the printing material S in the transport operation between the passes is 1/5 of the nozzle row length.

In The printed object printed in the printing process of the first mode, the 3-layer background image W and the 2-layer color image C are formed to overlap on the printing material S as shown at the lower portion of FIG. 11A. As described above, in the printed object of the first mode, the background image W is formed to be thick (3 layers), and thus the coloring property of the color image C is satisfactory when the front light is irradiated. However, when the back light is irradiated, the coloring property of the color image C deteriorates since the background image is thick.

Meanwhile, in the printed object printed in the printing process of the second mode, the 2-layer background image W and the 3-layer color image C are formed to overlap on the printing material S as shown at the lower portion of FIG. 11B. In the printed object of the second mode, the background image W is thinner than that of the printed object of the first mode, and thus light easily passes therethrough as compared with the printed object of the first mode. In addition, the color image C is formed in three layers. Accordingly, when the back light is irradiated, the coloring property of the color image C is satisfactory.

In addition, in the first mode, it is preferable to form the background image W to be thick, and in the second mode, it is preferable to form the background image W to be thin. Accordingly, for example, in the first mode, the 4-layer background image W and the 1-layer color image C may be formed to overlap, and in the second mode, the 1-layer background image W and the 4-layer color image C may be formed to overlap. In such a manner, it is possible to further improve the coloring property of the printed object of the first mode and the second mode.

Third Embodiment

In a third embodiment, the number of division of nozzles of the head 31 is different from that of the first embodiment. In addition, a configuration of the printer 1 and the printing process of the first mode are the same as those of the first embodiment, and thus the description thereof is not repeated.

Printing Process of Second Mode

The printing process of the second mode in the third embodiment will be described.

Figure 12:
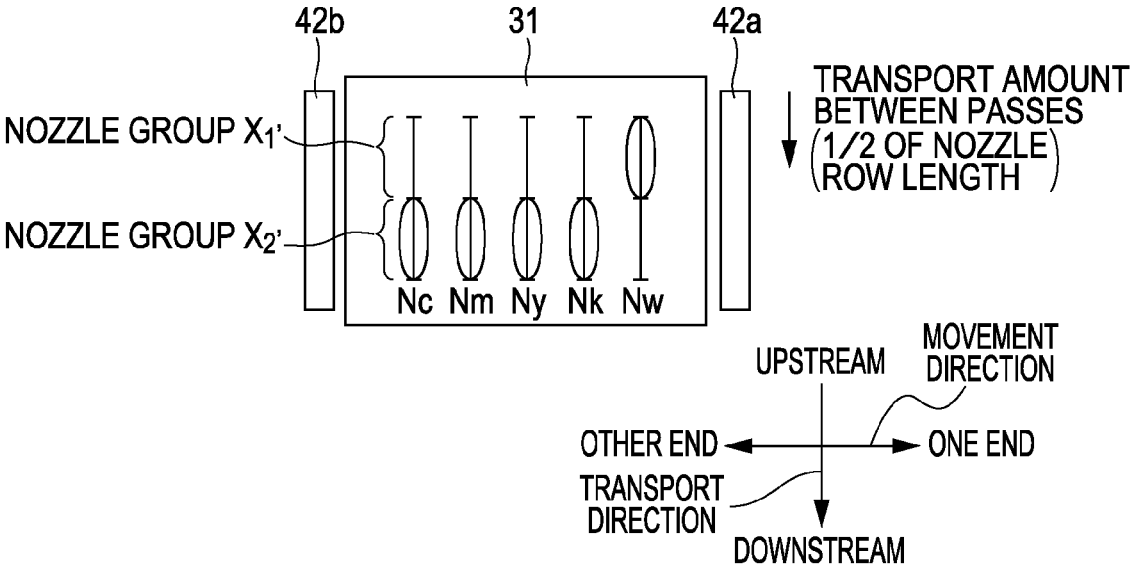
FIG. 12 is a diagram illustrating setting of nozzle groups when performing a printing process of a second mode in a third embodiment.

FIG. 12 is a diagram illustrating setting of nozzle groups when performing a printing process of a second mode in a third embodiment. To perform the printing of the second mode, the controller 60 divides each nozzle row of the head 31 into two nozzle groups as shown in FIG. 12. Between two nozzle groups, the nozzle group on the upstream side in the transport direction is $X_1'$, and the nozzle group on the downstream side in the transport direction is $X_2'$. As described above, in the second mode, the number of division (that is, the number of nozzle groups) of the nozzle row is smaller than that of the first mode. To perform the printing process of the second mode, the nozzle group $X_1'$ is used in the white ink nozzle row Nw. In addition, the nozzle group $X_2'$ is used in the color ink nozzle row.

Figure 13A:
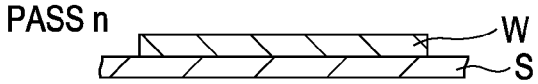
FIG. 13A and FIG. 13B are schematic diagrams sequentially illustrating formation of an image in the second mode.
Figure 13B:
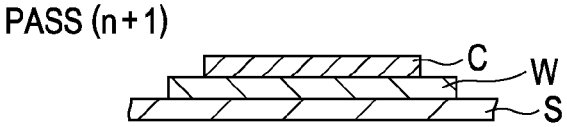

FIG. 13A and FIG. 13B are schematic diagrams sequentially illustrating formation of an image in the second mode. In addition, the printing material S has been already transported to the printing area of the printer 1, and an image is not yet formed on the printing material S at a position opposed to the nozzle group $X_1'$.

First, the controller 60 ejects ink from each nozzle of the head 31 while moving the carriage 21 in the movement direction (the forward direction), in the pass n (for example, the forward path). In this case, as shown in FIG. 12, the controller 60 ejects the W ink from the nozzle group $X_1'$ of the white ink nozzle row Nw of the head 31. In addition, the controller 60 ejects the color ink from the nozzles of the nozzle groups $X_2'$ of the color ink nozzle rows (Nc, Nm, Ny, and Nk) of the head 31. Accordingly, on the printing material S at the position opposed to the nozzle group $X_1'$, the W ink is ejected from the white ink nozzle row Nw, and the background image W is formed as shown in FIG. 13A. In addition, the controller 60 irradiates UV from the irradiation unit 42*a* on the upstream side in the movement direction. Accordingly, the background image W formed on the printing material S is immediately cured.

After the pass n, the controller 60 transports the printing material S to the downstream side in the transport direction by the transport amount of ½ (that is, the length of the nozzle group) of the nozzle row length (the transport operation). The printing material S moves by ½ of the nozzle row length to the downstream side in the transport direction. Accordingly, the background image W of FIG. 13A is transported to a position opposed to the nozzle group $X_2'$ by the transport operation. In addition, by this transport operation, the printing material S on which an image is not yet formed is transported to the upstream side in the transport direction of the printing area.

After the transport operation, the controller 60 performs the pass (n+1). The printer 1 performs the two-way printing. Accordingly, when the pass n is the forward pass, the pass (n+1) is the backward pass.

The controller 60 ejects the UV ink from the nozzles of the head 31 while moving the carriage 21 in the movement direction (the backward direction). In this case, the controller 60 ejects the W ink from the nozzles of the nozzle group $X_1'$ of the white ink nozzle row Nw of the head 31 similarly to the case of the pass n. In addition, the color is ejected from the nozzle group $X_2'$ of the color ink nozzle rows (Nc, Nm, Ny, and Nk) of the head 31. Accordingly, the color ink is ejected from each nozzle group $X_2'$ of the color ink nozzle row onto the background image W shown in FIG. 13A, and the color image C is formed to overlap on the background image W as shown in FIG. 13B.

In addition, the controller 60 irradiates UV from the irradiation unit 42*b* on the upstream side in the movement direction of the head 31 in the pass (n+1). As described above, in the pass (n+1), the movement direction is reverse to that of the pass n, and thus the irradiation unit used in the UV irradiation is different from that case of the pass n.

After the pass (n+1), the controller 60 transports the printing material S to the downstream side in the transport direction by the transport amount of ½ (that is, the length of the nozzle group) of the nozzle row length (transport operation). The printing material S is moved to the downstream side in the transport direction by ½ of the nozzle row length, and thus the background image W and the color image C shown in FIG. 13B are transported to the area (the downstream side in the transport direction from the head 31) other than the printing area by this transport operation.

Hereinafter, similarly, the controller 60 alternately and repeatedly performs the pass and the transport operation. Accordingly, the images are sequentially printed on the printing material.

Printed Object

Figure 14A:
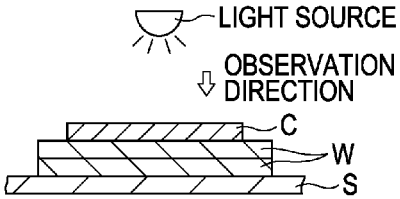
FIG. 14A is a diagram illustrating a printed object of a first mode in the third embodiment.
Figure 14B:
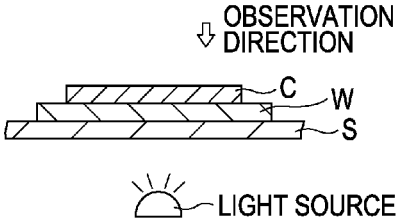
FIG. 14B is a diagram illustrating a printed object of the second mode in the third embodiment.

FIG. 14A is a diagram illustrating a printed object of a first mode in the first embodiment and the third embodiment, and FIG. 14B is a diagram illustrating a printed object of a second mode in a third embodiment.

The printed object printed in the printing process of the first mode, the 2-layer background image W and the 1-layer color image C are formed to overlap on the printing material S. When the printed object is irradiated with the front light, the background image W is printed to be thick. Accordingly, the coloring property of the color image C is satisfactory, and the color image C is easily viewed.

Meanwhile, in the printed object printed in the printing process of the second mode, the 1-layer background image W and the 1-layer color image C are formed to overlap on the printing material S. That is, the number of overlap is smaller than that of the printed object of the first mode. Particularly, the background image W is thinner than that of the case of the first mode. Accordingly, when the back light is irradiated, the light is more easily passes therethrough than the printed object of the first mode. Accordingly, when the printed object of the second mode is viewed by the back light, the coloring property of the color image C is more satisfactory as compared with the case where the printed object of the first mode is viewed by the back light.

As described above, in the mode (the first mode) of printing the image viewed by the front light, each nozzle row is divided into three nozzle groups, and the 2-layer background image W and the 1-layer color image C are formed to overlap on the printing material S. In addition, in the mode (the second mode) of printing the image viewed by the back light, each nozzle row is divided into two nozzle groups, and the 1-layer background image W and the 1-layer color image C are formed to overlap on the printing material S. As described above, the number of division of the first mode is larger than the number of division of the nozzle row of the second mode, and thus the number of overlap layers of the printed object of the first mode is larger than the number of overlap layers of the printed object of the second mode. Accordingly, for example, in the first mode, it is possible to form the background image W to be thick, and thus it is possible to improve the coloring property of the color image C. On the contrary, in the second mode, the number of overlap layers is smaller than that of the first mode, and thus the light more easily passes therethrough. Accordingly, when the image is viewed by the back light, it is possible to improve the coloring property of the color image C. In addition, in the first embodiment, the number of division of the nozzle row of the second mode is 2 that is the minimum value. In this case, it is preferable that the number of division of the nozzle row of the first mode be equal to or more than 3. Accordingly, in the first mode, the number of division of the nozzle row may be equal to or more than 4, and the color image C and the background image W may be formed to overlap equal to or more than total 4 layers.

Fourth Embodiment

In a fourth embodiment, the number of division of nozzles of the second mode is different from that of the third embodiment. In addition, a configuration of the printer 1 is the same as that of the third embodiment, and thus the description thereof is not repeated.

Figure 15A:
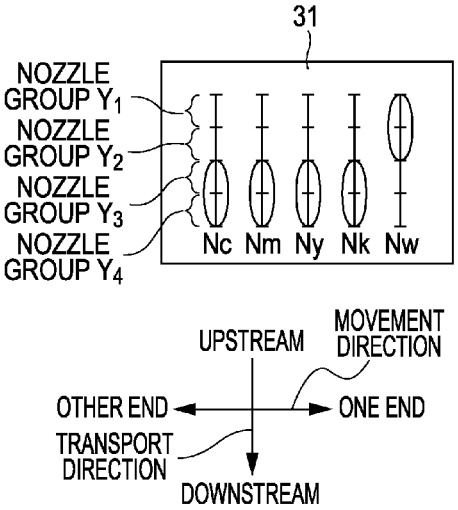
FIG. 15A is a diagram illustrating setting of nozzle groups of a first mode in a fourth embodiment.
Figure 15B:
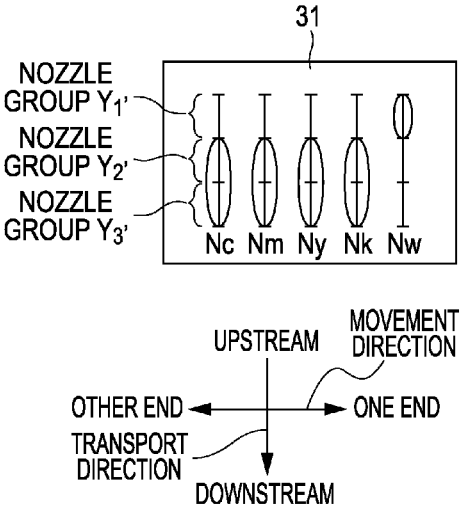
FIG. 15B is a diagram illustrating setting of nozzle groups of a second mode in the fourth embodiment.

FIG. 15A is a diagram illustrating setting of nozzle groups of a first mode in the fourth embodiment, and FIG. 15B is a diagram illustrating setting of nozzle groups of a second mode in the second embodiment.

In the first mode of the fourth embodiment, as shown in FIG. 15A, each nozzle row of the head 31 is divided into four nozzle groups ($Y_1$ to $Y_4$). In addition, the transport amount based on the transport operation between the passes is determined according to the number of division of the nozzle rows. For example, when the nozzle row is divided into n parts, the transport amount of the transport operation is 1/n of the nozzle row length. Herein, the nozzle row is divided into 4 parts (n=4), and thus the transport amount of the transport operation is ¼ of the nozzle row length. In addition, the nozzle group used in each printing mode is surrounded with a circle for indication. For example, in the white ink nozzle row Nw, the nozzle group $Y_1$ and the nozzle group $Y_2$ are used. In addition, in the color ink nozzle row, the nozzle group $Y_3$ and the nozzle group $Y_4$ are used.

In the second mode of the fourth embodiment, as FIG. 15B, each nozzle row of the head 31 is divided into three nozzle groups ($Y_1'$ to $Y_3'$) (3 uniform division). In addition, in FIG. 15B, the nozzle group used in each printing mode is surrounded with a circle for indication. For example, in the white ink nozzle row Nw, the nozzle group $Y_1'$ is used. In addition, in the color ink nozzle row, the nozzle group $Y_2'$ and the nozzle group $Y_3'$ are used.

As described above, even in the fourth embodiment, the number (4) of division of the nozzle row of the first mode is larger than the number (3) of division of the nozzle row of the second mode.

Even in the fourth embodiment, the pass and the transport operation are repeatedly performed similarly to the third embodiment, to form an image on the printing material S. In addition, as described above, the transport amount in the transport operation between the passes is determined according to the number of division of the nozzle rows.

Figure 16A:
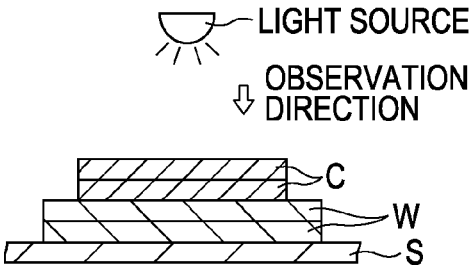
FIG. 16A is a diagram illustrating a printed objected printed in the first mode in the fourth embodiment.
Figure 16B:
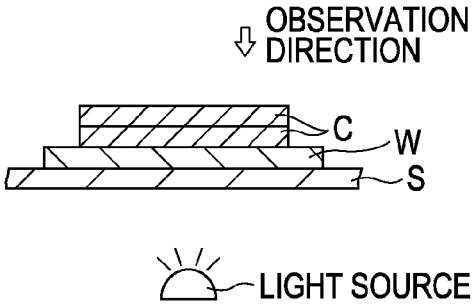
FIG. 16B is a diagram illustrating a printed object printed in the second mode in the fourth embodiment.

FIG. 16A is a diagram illustrating a printed objected printed in a first mode in the fourth embodiment, and FIG. 16B is a diagram illustrating a printed object printed in a second mode in the fourth embodiment.

As shown in FIG. 16A, the printed object printed in the printing process of the first mode, the 2-layer background image W and the 2-layer color image C are formed to overlap on the printing material S. When the printed object is irradiated with the front light, the background image W is printed to be thick (two layers). Accordingly, the coloring property of the color image C is satisfactory, and the color image C is easily viewed.

Meanwhile, as shown in FIG. 16B, in the printed object printed in the printing process of the second mode, the 1-layer background image W and the 2-layer color image C are formed to overlap on the printing material S. In this case, since the background image W is thinner than that of the case of the first mode, the light (the back light) more easily passes therethrough that the printed object of the first mode. Meanwhile, since the color image C are formed by 2 layers, it is possible to improve the coloring property of the color image C.

In addition, at the time of the first mode, in the white ink nozzle row Nw, the nozzle group $Y_1$ may be used, and in the color ink nozzle row, the nozzle groups $Y_2$ to $Y_4$ may be used. Accordingly, the 1-layer color image C and the 3-layer background image W may be formed to overlap.

In addition, in the first mode, the nozzle row may be divided into five or more parts, and the background image W and the color image C may be formed by 5 or more layers. For example, when the image are five layers, the 2-layer color image C and the 3-layer background image W may be formed to overlap, and the 1-layer color image C and the 4-layer background image W may be formed to overlap.

As described above, the number of overlap layers of the first mode is larger than the number of overlap layers of the second mode. Accordingly, in the first mode, for example, it is possible to form the background image W to be thick. When the front light is irradiated, it is possible to improve the coloring property of the color image C. In addition, in the second mode, the number of overlap layers is small. Accordingly, when the back light is irradiated, the light (the back light) is not easily blocked by the background image W or the like. Accordingly, it is possible to improve the coloring property of the color image C.

Other Embodiments

The printer and the like as an embodiment are described, but the embodiment is merely an example for easily understanding the invention, and does not limit the invention in analysis. It is obvious that the invention may be modified and improved without deviating from the concept, and the invention includes equivalents thereof. Particularly, the following embodiment is also included in the invention.

Printer

In the embodiments described above, the printer is described as an example of an apparatus, but the invention is not limited thereto. For example, a technique as the embodiments described above may be applied to various apparatus to which the ink jet technique is applied, such as a color filter manufacturing apparatus, a dying apparatus, a micro-processing apparatus, a semiconductor manufacturing apparatus, a surface processing apparatus, a 3-dimensional modeling apparatus, a liquid vaporizing device, an organic EL manufacturing apparatus (particularly, a polymer EL manufacturing apparatus), a display manufacturing apparatus, a film forming apparatus, and a DNA chip manufacturing apparatus.

Ejection Method

In the embodiments described above, the ink is ejected using the piezoelectric element. However, the method of ejecting a liquid is not limited thereto. For example, another method such as a method of generating bubbles in nozzles by heat may be used.

Ink

In the embodiments described above, the ink (the UV ink) cured by irradiation of ultraviolet light (UV) is ejected from the nozzles. However, a liquid ejected from the nozzles is not limited to such ink, and a liquid cured by irradiation of another light (for example, visible light or the like) other than UV may be ejected from the nozzles. In this case, it is preferable to irradiate light (visible light or the like) for curing the liquid from each irradiation unit.

In addition, ink other than such light curable ink may be used. For example, dots may be formed using resin ink, and the ink may be dried by heating the ink using a heater or the like. In addition, in this case, the UV irradiation unit may not be provided.

In addition, in the embodiments described above, the color ink is four colors of CMYK, but the other colors (for example, light cyan, and light magenta) of ink may be used.

In addition, in the embodiments described above, the white background image W is formed using the W ink, but ink other than the W ink may be used. For example, a background image with a color (silver or the like) different from that of the printing material may be formed using metallic ink with a color different from that of the printing material. In addition, the metallic ink is ink by which a printed object represents a metallic feeling. Such metallic ink may be, for example, an oily ink composition including a metal pigment, an organic solvent, and resin. To effectively generate a visibly metallic feeling, it is preferable that the metal pigment described above be flat particles. Such a metal pigment may be formed by, for example, aluminum or aluminum alloy, and may be manufactured by crushing a metal deposition film. A concentration of the metal pigment included in the metallic ink may be, for example, 0.1 to 10.0% by weight. Of course, the metallic ink is not limited to such a composition, the other composition generating a metallic feeling may be appropriately employed. As described, even when the metallic ink is used, it is preferable that the nozzle groups be set similarly to the W ink of the embodiment described above to eject the ink.

Irradiation Unit

In the embodiments described above, the UV irradiation units 42*a* and 42*b* are provided at both ends in the movement direction in the carriage 21. The used irradiation unit is changed according to the moving direction (the movement direction) of the carriage 21 in the two-way printing, but the invention is not limited thereto. For example, the irradiation unit may be provided at one end of the carriage 21 to perform one-way printing. In this case, at the time of the pass of forming dots, it is preferable to provide the irradiation unit to be positioned on the upstream side in the movement direction from the head. In such a manner, it is possible to perform the UV irradiation immediately after the forming of the dots. However, as described in the embodiments, when the carriage 21 is provided with the irradiation units 42*a* and 42*b* and the used irradiation unit is changed according to the movement direction of the carriage 21, it is possible to reduce the number of passes, and thus it is possible to raise a printing speed.

Controller

In the embodiments described above, the printer 1 corresponds to a liquid ejecting apparatus, and the controller 60 (the control unit) of the printer 1 controls the dot forming operation and the transport operation at the time of forming an image, but the invention is not limited thereto. For example, the liquid ejecting apparatus may be configured by an apparatus (a system) configured by a printer 1 and a computer 110. In this case, the computer 110 may be the control unit. Alternatively, the control unit may be configured by the controller 60 of the printer 1 and the computer 110.

Division of Nozzle Row

In the embodiments described above, each nozzle row may be divided in a manner other than those of the embodiments described above. In this case, at least, it is preferable that the number of division of the nozzle rows in the first mode be larger than the number of division of the nozzle rows in the second mode. In this case, it is possible to increase the number of overlap layers of the background image W and the color image W in the first mode, and thus it is possible to improve the coloring property of the color image C. In addition, in the first mode, it is preferable that the background image W be thick, and in the second mode, it is preferable that the background image W be thin.

Recording Method

In the embodiments described above, the bandwidth printing recording method according to the number of division of the nozzle rows is described, but the other printing recording method may be used. For example, an interlacing printing recording method using nozzles in divided ranges may be used. The interlacing printing means a printing method in which a formed dot distance d is twice or more the nozzle pitch D ($D=k\cdot d$, k is equal to or more than 2), and a non-recorded raster line is interposed between raster lines recorded in one pass. That is, interlacing printing, it is possible to form a color image and a background image with resolution higher than the nozzle pitch D. In an example described hereinafter, k is 4, and three raster lines are interposed between raster lines formed by one pass. In addition, as described above, the raster line is a dot line (a row of dots) arranged in a movement direction formed by intermittent ejection of ink droplets from nozzles moving in the movement direction at the time of pass.

In the interlacing printing, whenever a printing material is transported in a transport direction by a regular transport amount F, each nozzle records a raster line right above a raster line recorded in the previous pass. As described above, to perform the recording with a regular transport amount, there are two conditions of (1) the number of nozzles N (integer number) capable of ejecting ink is in a disjoint relationship with k and (2) the transport amount F is set to $N\cdot d$.

In a case of the interlacing printing, to complete the raster lines in which a nozzle pitch width is continuous, k-times passes are necessary. For example, to complete four continuous raster lines at a dot distance of 720 dpi using nozzle rows with a nozzle pitch of 180 dpi, four-times passes are necessary.

Figure 17:
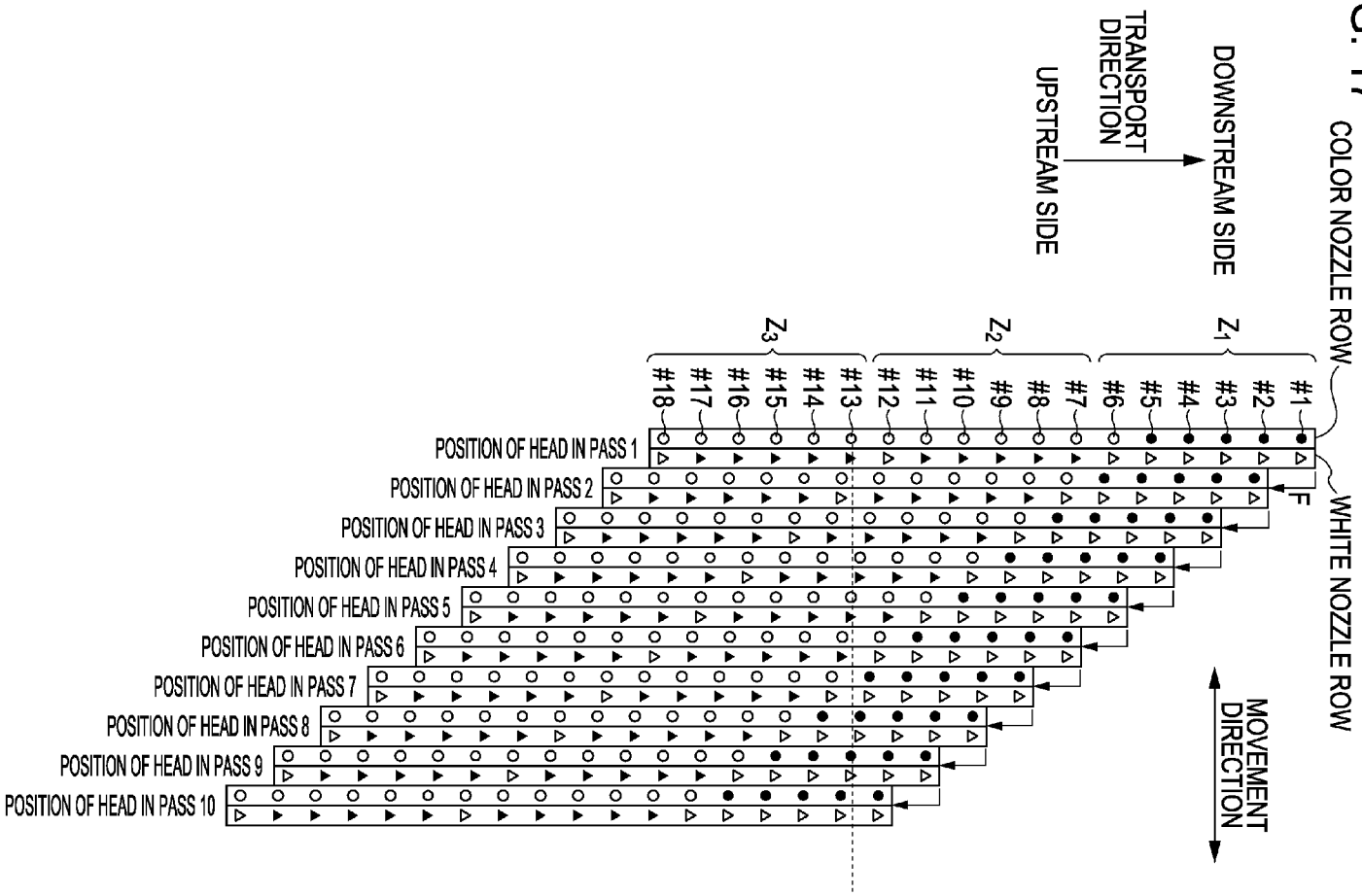
FIG. 17 is a diagram illustrating an embodiment of the invention based on an interlacing recording printing method.

FIG. 17 is a diagram illustrating an embodiment of the invention based on an interlacing recording printing method. In FIG. 17, for simplification of description, color nozzle rows of color ink (cyan, magenta, yellow, and black) are indicated as one nozzle row. In addition, the nozzles of the color nozzle rows are indicated by circles, and the nozzle rows of white are indicated by triangles. In addition, in FIG. 17, the nozzles indicated by black are nozzles capable of ejecting ink, and the nozzles indicated by white are nozzles which cannot eject ink. In addition, for convenience of description, the head (the nozzle row) is shown to move with respect to the printing material, but FIG. 17 shows a relative position between the head and the printing material. In actual, the printing material is transported in the transport direction.

In addition, in the embodiment, for simplification of description, the number of nozzles of each nozzle row is 18. Each nozzle row is divided into three parts, which are three nozzle groups ($Z_1$, $Z_2$, and $Z_3$).

For example, when the 2-layer background image W is formed and then the color image C is formed thereon, the nozzle group $Z_1$ (the nozzles #1 to 6) of the color nozzle row, and the nozzle group $Z_2$ (the nozzles #7 to 12) and the nozzle group $Z_3$ (the nozzles #13 to 18) of the white nozzle row are used. When the interlacing printing is performed by six nozzles to satisfy the conditions ((1) the number of nozzles N (integer number) capable of ejecting ink is in a disjoint relationship with k and (2) the transport amount F is set to N·d.) of the interlacing printing described above, ink is ejected from five nozzles, and a medium is transported by a transport amount of 5·d.

As described above, by forming the dots, the white dots are formed twice on the printing material by the nozzles of the white nozzle row, and then color dots may be formed by the nozzles of the color nozzle row. For example, in the raster lines at the position indicated by a dot line in FIG. 17, the white dots are formed in the pass 1, the white dots are formed in the pass 5, the color dots are formed in the pass 9. Accordingly, it is possible to form the 1-layer color image on the 2-layer background image. In addition, when the printing is performed in the same manner using the nozzle groups $Z_1$ and $Z_2$ of the color nozzle row and the nozzle group $Z_3$ of the white nozzles, it is possible to form the 2-layer color image on the 1-layer background image.

Printed Object

In the embodiments described above, the case of forming the printing object on which the image is viewed from the printing face side is described. However, for example, an image may be formed on a transparent printing material, and a printing object on which the image is viewed from the opposite side to the printing face may be formed. for example, in a case of the first mode of the first embodiment, when the color ink is ejected from each nozzle group $X_1$ of the color ink nozzle rows (Nc, Nm, Ny, and Nk) of the head 31 and the W ink is ejected from the nozzle groups $X_2$ and $X_3$ of the white ink nozzle row Nw of the head 31, the 1-layer color image C is formed on the printing material S, and the 2-layer background image W is formed thereon. In a case of this printing object, the color image C based on the 2-layer background image W is viewed from the opposite face (the non-printing face) of the printing face through the transparent printing material S. In addition, in such a printing object, the non-printing face of the printing material is irradiated with the front light, and the printing face of the printing material is irradiated with the back light.

Even in this case, the color image C and the background image W are formed to overlap similarly to the embodiment described above, and thus it is possible to improve the coloring property.

In the embodiments described above, the configuration of transporting the printing material in the transport direction is employed, but the invention is not limited thereto. For example, in a state where the printing material is fixed at a predetermined position, the head 31 may be moved in a movement direction and a direction intersecting the movement direction to perform printing. In addition, both of the printing material and the head 31 may be moved in a direction intersecting the movement direction to perform printing. That is, at least one of the head 31 and the printing material may be moved, and the head 31 may be moved relatively with respect to the printing material.

The entire disclosure of Japanese Patent Application No. 2011-223654, filed Oct. 11, 2011, No. 2011-240064, filed Nov. 1, 2011, No. 2012-176771, filed Aug. 9, 2012 and No. 2012-176772, filed Aug. 9, 2012 are expressly incorporated by reference herein.

What is claimed is:

1. An image forming apparatus comprising:

a nozzle row group that includes a first nozzle row in which a plurality of nozzles for ejecting a first liquid for forming a main image are arranged in a first direction, and a second nozzle row in which a plurality of nozzles for ejecting a second liquid for forming a subsidiary image assisting the main image are arranged in the first direction, the second nozzle row being provided in parallel to the first nozzle row and disposed a distance from the first nozzle row in a second direction intersecting the first direction; and a control unit that performs a dot forming operation of ejecting a liquid from each nozzle to form dots on a printing material while moving the nozzle row group in the second direction, and a movement operation of moving at least one of the printing material and the nozzle row group in the first direction to form an image on the printing material, wherein the control unit divides each of the first nozzle row and the second nozzle row into N (N is an integer equal to or more than 3) nozzle groups when the dot forming operation is performed, wherein in a first mode, A nozzle groups of N nozzle groups of the second nozzle row and (N−A) nozzle groups of the first nozzle row are employed to form the subsidiary image of A layers and the main image of (N−A) layers are formed to overlap on the printing material, and wherein in a second mode, B (A≠B) nozzle groups of N nozzle groups of the second nozzle row and (N−B) nozzle groups of the first nozzle row are employed to form the subsidiary image of B layers and the main image of (N−B) layers are formed to overlap on the printing material.

2. The image forming apparatus according to claim 1, wherein the first mode is a mode in which one face of the printing material is irradiated with light to print a printed object for viewing an image on the one face side, and wherein the second mode is a mode in which the other face of the printing material is irradiated with light to print a printed object for viewing an image on the one face side.

3. The image forming apparatus according to claim 1, wherein a value of A is larger than a value of B.

4. The image forming apparatus according to claim 1, wherein a value of (N−B) is equal to or larger than a value of B.

5. The image forming apparatus according to claim 1, wherein in the first liquid, a dye is used as a coloring agent, and wherein in the second liquid, a pigment is used as a coloring agent.

6. The image forming apparatus according to claim 1, wherein the first liquid and the second liquid are liquids cured by irradiation of light, and wherein the image forming apparatus further comprises: an irradiation unit that irradiates the dots formed on the printing material by the first nozzle row and the second nozzle row, with the light.

7. An image forming method of forming an image on a printing material by an image forming apparatus including a nozzle row group that includes a first nozzle row in which a plurality of nozzles for ejecting a first liquid for forming a main image are arranged in a first direction, and a second nozzle row in which a plurality of nozzles for ejecting a second liquid for forming a subsidiary image assisting the main image are arranged in the first direction, the second nozzle row being provided in parallel to the first nozzle row and disposed a distance from the first nozzle row in a second direction intersecting the first direction, the method comprising:

dividing each the first nozzle row and the second nozzle row into N (N is an integer equal to or more than 3) nozzle groups;

forming dots on a printing material by employing A nozzle groups of N nozzle groups of the second nozzle row and (N−A) nozzle groups of the first nozzle row in a first mode, and forming dots on the printing material by employing B (A≠B) nozzle groups of N nozzle groups of the second nozzle row and (N−B) nozzle group of the first nozzle row in a second mode, while moving the nozzle row group in the second direction; and moving at least one of the printing material or the nozzle row group in the first direction in the forming of the dots, wherein in the first mode, the subsidiary image of A layers and the main image of (N−A) layers are formed to overlap on the printing material, and in the second mode, the subsidiary image of B layers and the main image of (N-B) layers are formed to overlap on the printing material.

* * * * *